US006842940B2

(12) United States Patent
Christopher et al.

(10) Patent No.: US 6,842,940 B2
(45) Date of Patent: Jan. 18, 2005

(54) FLOOR SCRUBBER

(75) Inventors: Ronald M. Christopher, Aberdeen, NC (US); Timothy A. Strickland, Raeford, NC (US)

(73) Assignee: Minuteman International, Inc., Addison, IL (US)

( * ) Notice: Subject to any disclaimer, the term of this patent is extended or adjusted under 35 U.S.C. 154(b) by 0 days.

(21) Appl. No.: 10/764,896

(22) Filed: Jan. 26, 2004

(65) Prior Publication Data

US 2004/0154123 A1 Aug. 12, 2004

Related U.S. Application Data

(60) Provisional application No. 60/446,915, filed on Feb. 12, 2003.

(51) Int. Cl.[7] ..... E01H 1/02; E01H 1/08

(52) U.S. Cl. ..... 15/320; 15/340.4

(58) Field of Search ..... 15/320, 340.1, 15/340.2, 340.3, 340.4

(56) References Cited

U.S. PATENT DOCUMENTS 4,173,052 A * 11/1979 Burgoon et al. ..... 15/83
4,429,433 A * 2/1984 Burgoon ..... 15/320
4,884,313 A * 12/1989 Zoni ..... 15/340.3
5,623,743 A * 4/1997 Burgoon et al. ..... 15/320
5,630,286 A * 5/1997 Vanderlinden ..... 37/227
5,940,928 A * 8/1999 Erko ..... 15/319
6,035,479 A * 3/2000 Basham et al. ..... 15/83

* cited by examiner

*Primary Examiner*—Terrence R. Till
(74) *Attorney, Agent, or Firm*—Emrich & Dithmar LLC

(57) ABSTRACT

A floor scrubber includes a forward cylindrical brush with adjustable down pressure. The cylindrical brush is sprayed uniformly with a controlled amount of water or solution and moves debris forward with a direct propelling action into a collection hopper. A set of three disc brushes is located behind the cylindrical brush, followed by a suction liquid recovery device for suctioning spent solution. A control system allows independent use of the forward cylindrical brush, or the rear disc brush set, or all brushes. A floor-engaging flap having a central opening extends transverse of the machine behind the cylindrical brush to channel water from the cylindrical brush to the disc brush set and then to the suction recovery device.

12 Claims, 6 Drawing Sheets

FLOOR SCRUBBER

RELATED APPLICATION

This application claims the benefit of U.S. Provisional Application No. 60/446,915 filed on Feb. 12, 2003 for "FLOOR SCRUBBER".

FIELD OF THE INVENTION

The present invention relates to floor scrubbing machines; and more particularly, it relates to a rider scrubber using driven scrub brushes and a cleaning solution to loosen and remove debris, followed by a vacuum recovery system for suctioning up the spent solution.

SUMMARY OF THE INVENTION

Rider scrubbers have been known in the industry for some time. One of the problems with a rider scrubber is that the suction recovery system can become plugged with loose or wet debris removed from the floor. It is important, therefore, to remove as much of the debris as possible ahead of the suction recovery system which is normally in the form of a curved squeegee coupled to a source of suction created by a powered fan, which generates a pressure reduced below atmosphere in a sealed tank. The suction pressure is communicated to the squeegee for recovering the spent solution from the floor.

Attempts have been made to increase the scrubbing effectiveness of a rider scrubber by using the same type of cylindrical scrub brush also used in sweeping (i.e. dry) machines. In one commercial machine, a pair of counter-rotating cylindrical brushes are located in fore and aft positions in close proximity to each other, with their axes of rotation extending parallel to one another and transverse of the movement of the machine. In this construction, the forward brush is rotated in one direction (counter clockwise when viewed from the left side) to throw loosened debris rearwardly to the second cylindrical brush in an underhand type of throw which causes most of the debris to land directly on the rear brush. Some debris usually is re-cycled by the forward brush. The rear brush is rotated clockwise in a direction to carry the debris upwardly and rearwardly over a raker blade which removes the debris from the bristles and routes it into a rear collection hopper from which the water drains. The water is then collected by the suction recovery system.

One of the shortcomings of using cylindrical brushes is that the contact area (or "footprint") of a cylindrical brush is only a small portion of the overall useable bristle area, as opposed to well-known disc type brushes wherein substantially all of the bristles typically contact the surface being cleaned for continuous scrubbing action by all or substantially all of the bristles of the brush.

Cylindrical type brushes were originally used in sweeping machines and rider sweepers which did not use water or cleaning solution to wet the debris and facilitate its recovery. In an application which is solely sweeping, it was typically the practice not to apply a downward force on the cylindrical brush because it increases bristle wear and reduces the useful life of the brush. Thus, dry sweeping applications using cylindrical brushes typically were designed so that the weight for the support arms of the brush did not add substantial downward force of the weight of the brush itself in an effort to extend the useful life of the brush. Moreover, some prior machines included stops to limit the downward motion of the brush and thus limit the downward force on the bristles. In sweeping applications, as opposed to scrubbing applications, this may have been a useful idea. However, we have found that for scrubbing applications, the effectiveness of scrubbing using a cylindrical brush can be increased by applying some downward force to the brush above the weight of the brush and its support. It is particularly advantageous to provide an adjustment of the applied downward force.

Other problems with existing scrubbing systems using two counter-rotating cylindrical brushes with drip-type water dispersion include a lack of uniform application of water to the forward brush. In order to provide a sufficient amount of water to all areas of the brush, some areas have excess water, resulting in an accumulation of excess water between the two brushes. The excess water accumulation is due at least in part to the fact that the counter-rotating brushes tend to force the water to the region between the brushes, thus building up a head of water between the brushes, which eventually trickled out the sides of the brushes, leaving undesirable strips or streaks of water along the edges of the cleaning swath of the machine.

Further, for scrubbing applications, cylindrical brushes perform best on flat surfaces. In practical applications, however, many floor surfaces even in commercial buildings having areas which are uneven. Since cylindrical brushes are necessarily constructed to have a rigid center support, they are not particularly effective in scrubbing recesses in the floor. They tend to "bridge" across recesses having an extension less than the length of the brush. This is particularly true when the only down pressure is the weight of the brush and its mount. Further, the brush may be elevated slightly when passing over a ridge in the floor, thus reducing the effectiveness of scrubbing lower areas in the floor.

SUMMARY OF THE INVENTION

The present invention includes, in a rider scrubber, a forward cylindrical brush having an actuator with an adjusting device for raising and lowering the cylindrical scrub brush and for applying and adjusting downward pressure during use. A rear scrubbing mechanism includes a set of disc brushes, which has a separate actuator for raising and lowering the disc brushes. Both the forward and rear scrubbing mechanisms are provided with a source of water. As used herein, "water" is intended to include liquid cleaning solutions (which are normally highly concentrated and greatly diluted in water). However, the two water supplies operate independently of one another, though they both draw from the same solution tank.

The forward water source includes spray nozzles directed downwardly onto the forward cylindrical scrub brush. The nozzles are fed by a constant displacement pump, and provide a uniform, measured dispersion of water across the entire cylindrical brush. By metering the water and dispensing the water uniformly across the entire cylindrical brush, the problem of excess water application is avoided. By reducing the amount of water for the cylindrical scrub brush, and by eliminating a second, counter-rotated cylindrical scrub brush following the first, the above-mentioned problem of water accumulation between the cylindrical scrub brushes having a tendency to trickle out the sides of the machine and leave streaks is eliminated. The machine is thus able to operate longer on the same amount of water, and the total amount of liquid collected by the vacuum system is reduced, and the debris which is ultimately collected is less soggy than if it were saturated with water.

The forward cylindrical scrub brush is rotated such that the bristles move forwardly after engaging the floor to deliver the collected debris to a location in front of the cylindrical brush by propelling it directly to a forward hopper in a forward-propelling motion.

Behind the forward scrub brush is a flexible contaminant flap which engages the floor to reduce undesirable water spray. The center section of the flap is provided with an opening to channel the water collected by the contaminant flap away from the sides where a water streak might otherwise appear, and toward the center of the machine to facilitate pickup by the trailing suction system.

The disc brush set preferably comprising three disc brushes is located behind the forward cylindrical brush. Each of the disc brushes is provided with its own drive motor, as is conventional; and all three disc brushes are mounted to a common head or lift frame which may be raised or lowered by a powered actuator under control of the operator. Thus, the cylindrical brush and the disc brush set may be independently placed in the use position. Further, a downward force may be independently applied to either the forward cylindrical brush or the rear disc brush set, or to both of them, and the downward force applied to the forward brush is controlled separately from the downward force applied to the rear disc brush set. The independent adjusting mechanisms for the forward cylindrical brush and the rear disc brushes each includes a spring cushion mechanism to protect the actuator against undue shock or force.

If it is desired to increase the amount of water being sprayed on the forward cylindrical brush, the nozzles may be changed to a suitable size orifice. Moreover, the constant displacement water pump is powered independently of the water source to the rear disc brush set, as will be described. This feature, together with the dual actuators for the forward cylindrical brush and rear disc brush set permit the machine to be operated in any one of three conditions, selected by the operator: (1) both the forward cylindrical brush and the rear disc brush set may be in the use or scrubbing position; (2) the forward cylindrical brush set may be raised to disengage the floor with the constant displacement pump shut off and the rear disc brush set is in the use portion for scrubbing; or (3) the apparatus can be converted to a sweeper by replacing the forward cylindrical scrub brush with a cylindrical sweeping broom turning off the water supply, raising the rear disc brush set and the squeegee, and covering the grate work in hopper to collect small dust.

Other features and advantages of the present invention will be apparent to persons skilled in the art from the following detailed description of one embodiment accompanied by the accompanying drawing wherein identical reference numerals will refer to like parts in the various views.

DETAILED DESCRIPTION OF THE ILLUSTRATED EMBODIMENT

Figure 1:
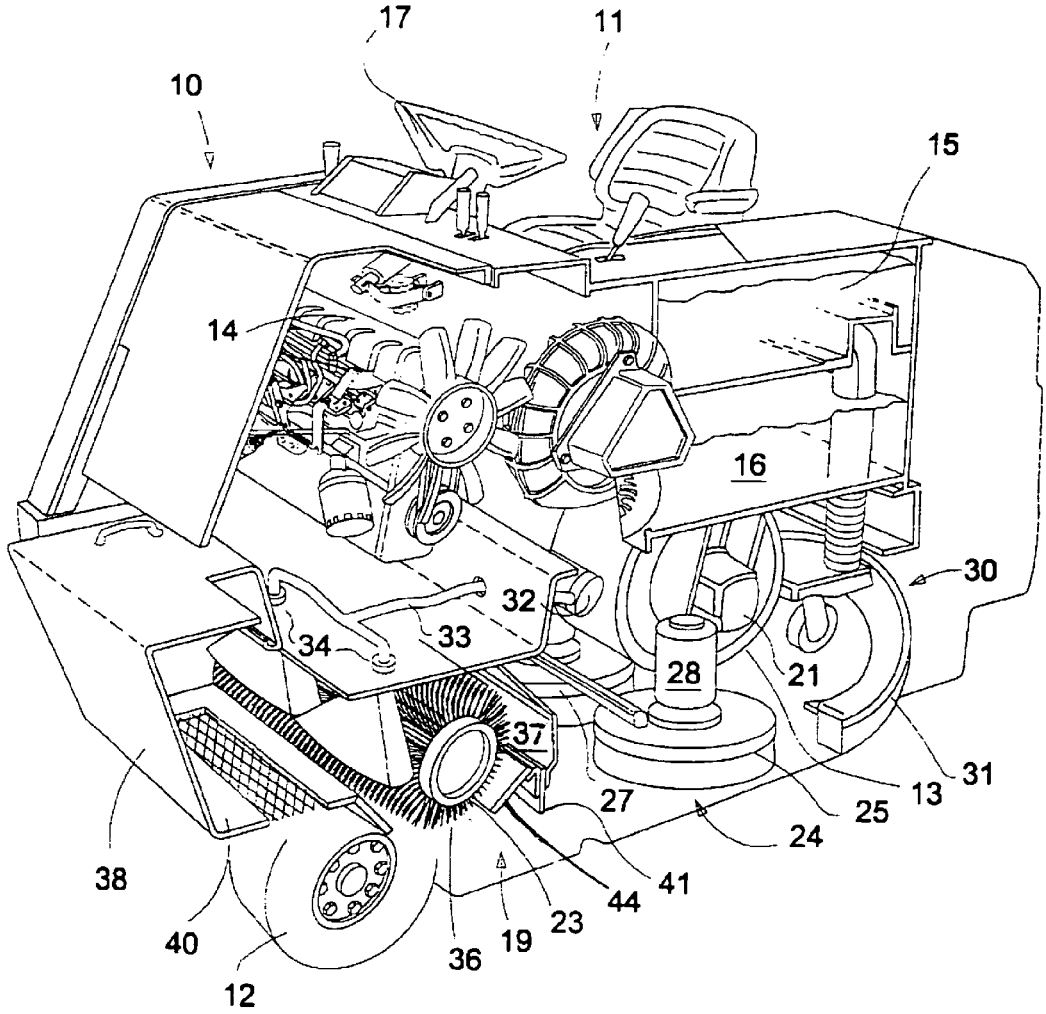
FIG. 1 is a left, frontal perspective view of a machine incorporating the present invention with the left side of the cover panels broken away to show the interior components.

Referring first to FIG. 1, there is shown a floor scrubbing machine generally designated 10 in the form of a rider scrubber including an operator station generally designated 11, a pair of forward support wheels, one of which is seen at 12, a single rear steering wheel 13, an engine 14, a clean water or solution tank 15, and a recovery tank generally designated 16. The steerable wheel 13 is controlled by an operator seated at the operator station 11 by means of a steering wheel 17 and conventional steering mechanism. As is also known, the rear steerable wheel 13 is driven by a hydraulic motor 21 which is powered by the engine 14. The machine of FIG. 1 is covered by suitable paneling, and it is a self-contained vehicle. All of the components identified above are conventional, and need not be described further to persons skilled in the art.

The machine includes a forward scrubbing element 19 in the form of a conventional cylindrical brush 23 which will be described further below. Behind the forward cylindrical scrub brush 23, there is a set of rear scrubbing elements generally designated 24. In the preferred embodiment, the rear scrubbing elements comprise three disc brushes 25, 26 (seen in FIG. 2) and 27. Each of the disc brushes 25–27 is conventional and driven by a separate hydraulic motor such as that designated 28 in FIG. 1 for the left rear disc brush 25 and FIG. 6 for the forward disc brush 27. As seen better in FIG. 3, the disc brushes are arranged with their vertical axes forming a triangle—that is, the disc brush 27 is located in a forward position and midway between the two rear disc brushes 25, 26 (the latter being driven by motor 28A in FIG. 6).

Located behind the disc brush set 24 and the driven wheel 13, is a vacuum suction system generally designated 30 and including a conventional parabolic squeegee recovery element 31.

It will be helpful to provide an overall description of the machine thus far described in order to better understand the more detailed description which follows. Water (or a solution of fresh water and cleaning chemical) is stored in the solution tank 15. As mentioned, whether or not the applied liquid contains a cleaning chemical, it will be referred to from hereon as "water" for simplicity and to distinguish it from the dirty or spent solution recovered by the vacuum system.

There are two separate feed systems for the water from the solution tank 15. A first feed system is coupled to a constant displacement pump 32 which is turned on and off by a switch actuated by the operator and energized by the electrical system of the vehicle. The output of pump 32 is fed via a conduit 33 to spray nozzles 34 under pressure.

The nozzles 34 are mounted above and to the front of the cylindrical brush 23. The nozzles 34 are chosen (more than two, if needed) to provide a fine spray which extends across substantially the entire axial length of the cylindrical brush 23 and, as illustrated in FIG. 1, on the forward portion of the brush.

Figure 3:
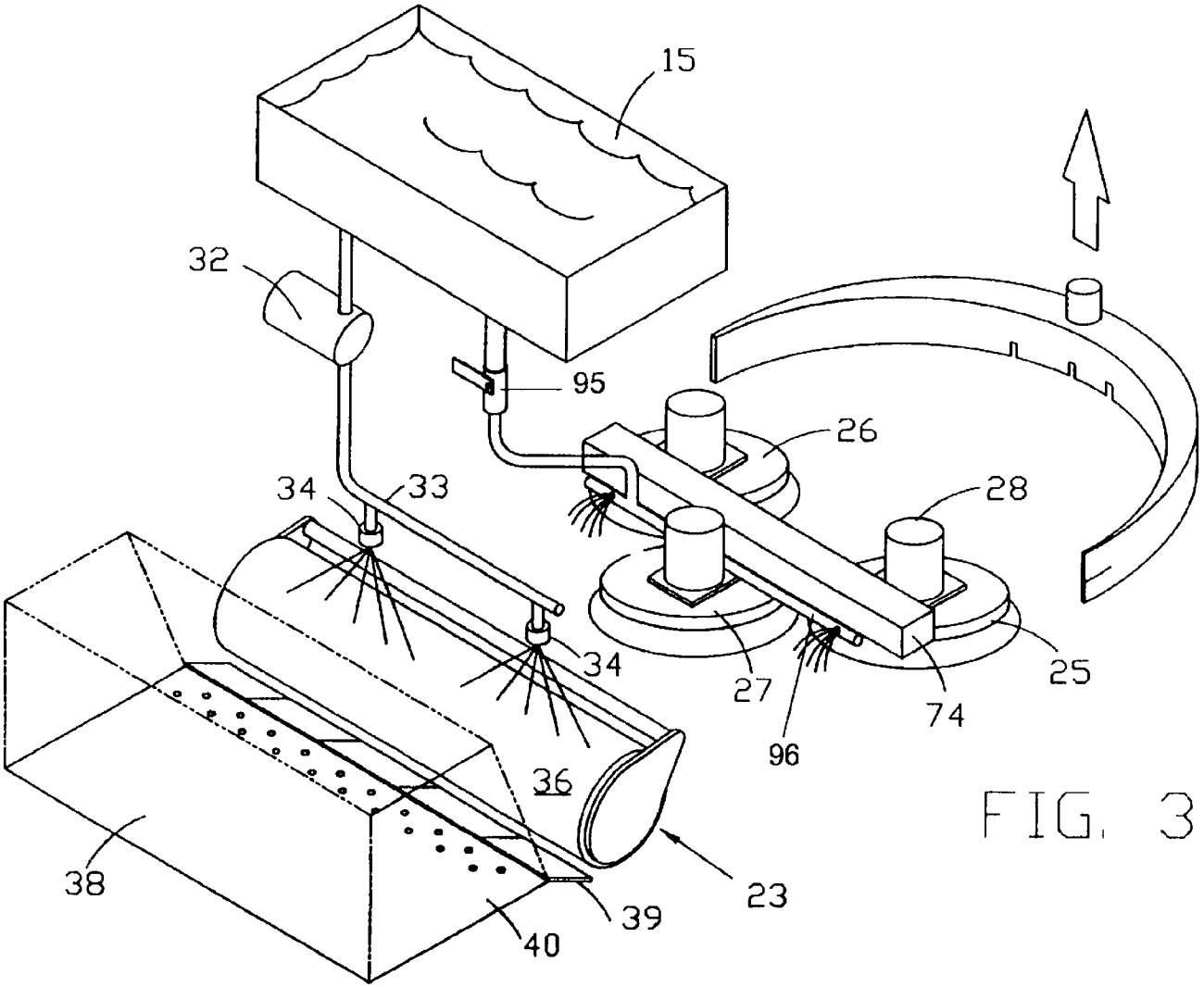
FIG. 3 is a perspective view of the primary cleaning components of the scrubber machine of FIG. 1 shown partly in schematic form for simplicity.

The cylindrical brush 23 in the illustrated embodiment includes a series of bristle sections, such as those designated 36 in FIG. 1. The bristle sections 36 are conventionally comprised of individual tufts set in rows which may extend the axle length of the cylindrical brush and extend in a slight helix about the axis of the brush. The brush 23 is driven in a clockwise direction as viewed from the left in FIG. 1 so that the bristles are wetted immediately after they engage the floor or other surface being scrubbed. The word "floor" is intended to be construed broadly to include all surfaces capable of being scrubbed. Loose debris and other debris which is removed from the surface being scrubbed by the cylindrical brush is thus urged forwardly in a direct propelling motion tangential of the ends of the bristles of the brush 23, upwardly and forwardly into a forward debris hopper 38. The debris hopper 38 includes a lower semi-rigid wall 39 (FIG. 3) of flexible cloth-reinforced neoprene which is attached to the bottom wall 40 of the hopper 38 and dragged behind the hopper to provide a ramp for the debris being propelled from the bristles of the cylindrical brush. The bottom wall 40 contains openings (for example, in the form of individual holes as seen in FIG. 3 or a larger screened opening 43 as seen in FIG. 1) to filter out and capture the debris while permitting the water to drain from the hopper and then be collected in the vacuum recovery system as will be apparent.

A flexible containment flap 41 (made of cloth-reinforced rubber or similar semi-rigid material) is mounted to a support member 37 which is connected to the frame F of the machine behind the cylindrical brush 23, and it extends the width of the brush 23. A central opening 42 (FIG. 2) is formed in the containment flap 41.

A semi-rigid recirculation flap 44 is also mounted to the support frame member 37, and it may be of cloth-reinforced rubber, the lower, forward edge of which engages the bristles 36 of the cylindrical brush 23. As the cylindrical brush is rotated (counterclockwise in FIG. 2) the outer edges of the bristles engage the recirculation flap 44 and snap forward as they pass the distal edge of the flap 44, thereby propelling debris from the bristles and onto the surface being cleaned where the bristles recover the debris and throw it into the collection hopper 38. It may be that some debris will recirculate for one or more revolutions of the cylindrical brush, but eventually most larger debris is separated from the cylindrical brush and collected in the hopper 38.

Through the use of spray nozzles such as the ones designated 34 mounted adjacent the cylindrical brush 23 and by feeding the spray nozzles with a constant displacement pump 32, a uniform, controlled spray is spread across the entire axial length of the brush 23. This avoids a problem of certain prior machines which dripped water from the supply onto a forward cylindrical brush followed by a second, counter-rotating cylindrical brush. In such a system, in order to get sufficient water supply for all sections of the cylindrical brush, some sections had excess water and the excess water accumulated between two cylindrical brushes. The water was trapped because the brushes were counter-rotated such that the floor-engaging bristles of the brushes were moved toward each other near the floor, which inhibited water flow to the rear, thereby accumulating a level or head of water between the brushes under certain conditions. The accumulated water in such a system tends to travel around a rear contaminant flap (the purpose of which is to reduce spray), and such a system leaves streaks of water adjacent each side of the machine. In addition to controlling the application of water to the brush in a uniform pattern, thereby reducing the amount of water necessary to be applied to the brush, and eliminating the rear, counter-rotating cylindrical brush, the present system routes the water on the floor through the central opening 42 of the contaminant flap 41, thereby eliminating or greatly reducing undesirable streaks of water to either side of the machine.

Figure 2:
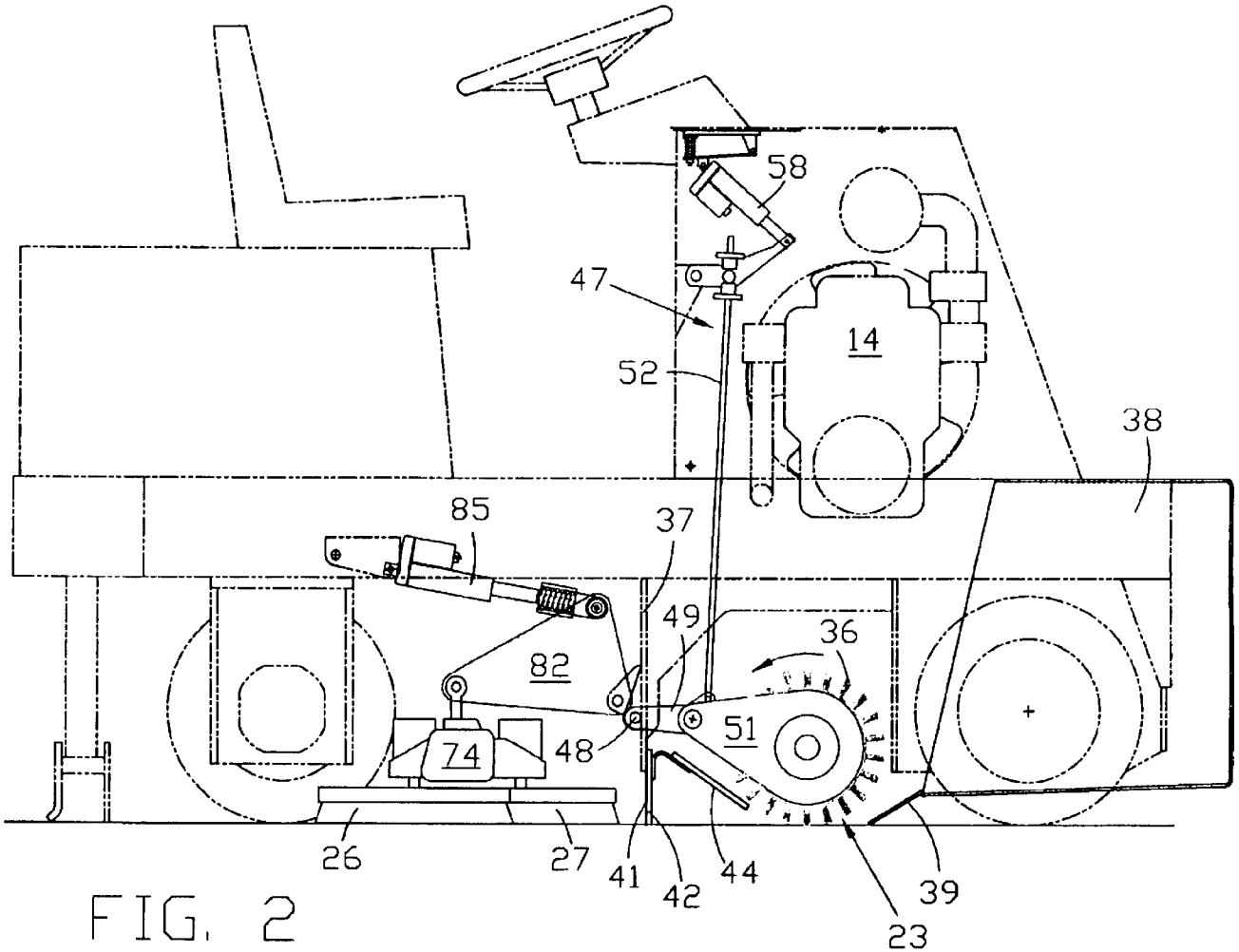
FIG. 2 is a right side elevational view of the portions of the machine of FIG. 1 relating to the present inventions.
Figure 4:
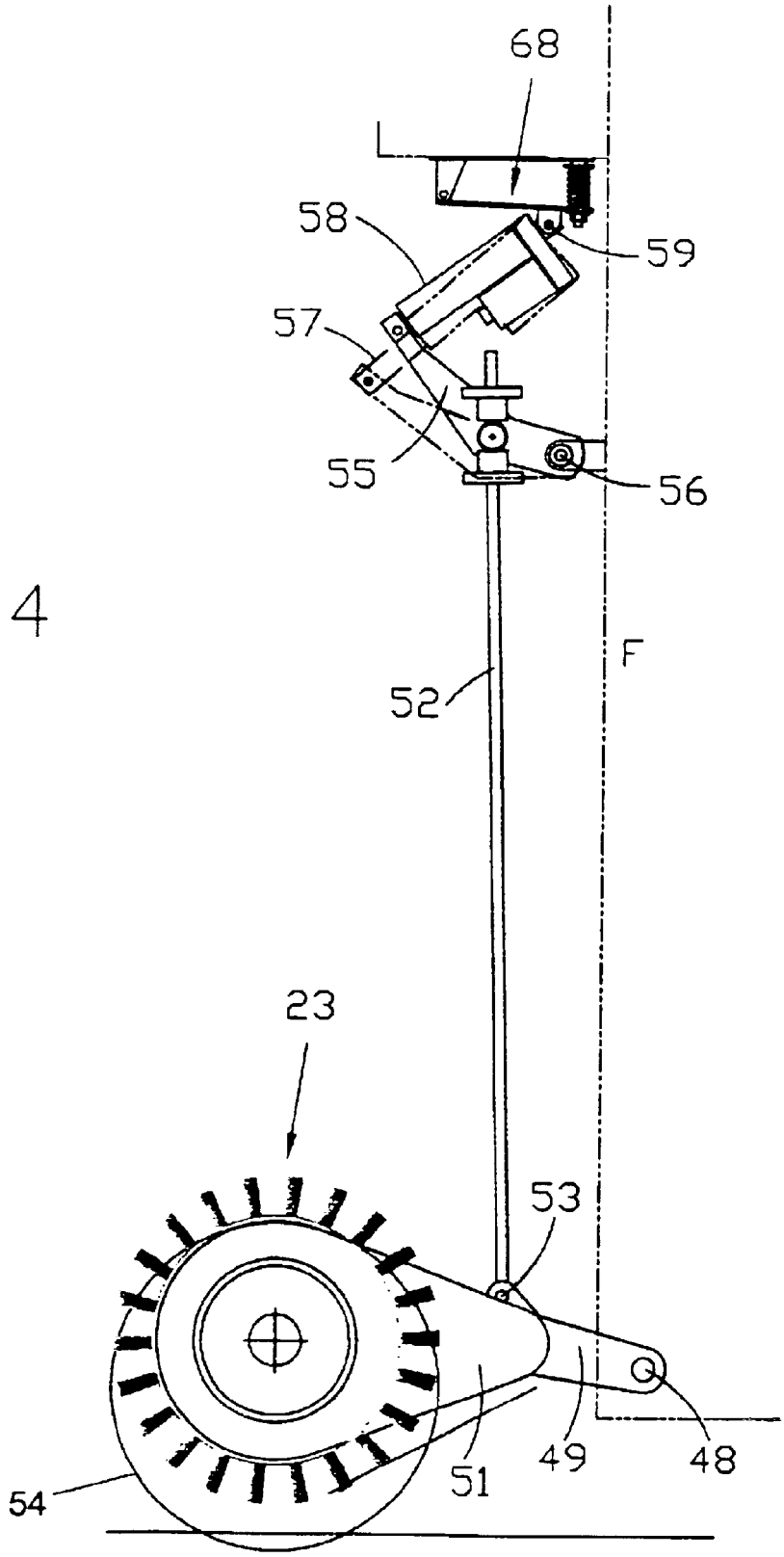
FIG. 4 is a left side elevational view of the actuating mechanism for the cylindrical brush of the machine of FIG. 1.
Figure 5:
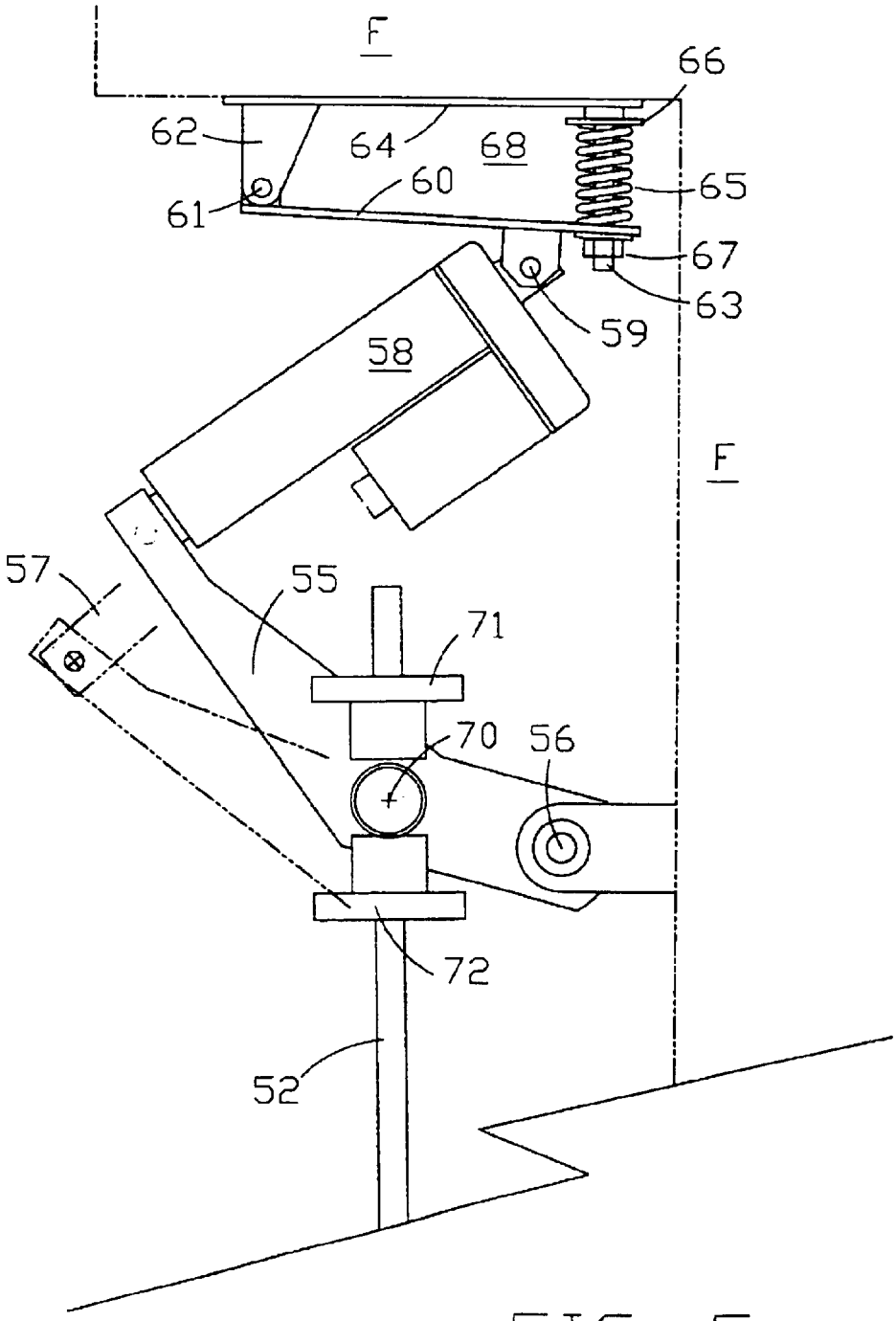
FIG. 5 is a close up view of the adjusting mechanism for the actuating system of FIG. 4.

The forward cylindrical brush 23 is mounted to the vehicle by a vertical adjusting system generally designated 47 in FIG. 2, and seen in more detail in FIGS. 4 and 5. The forward brush adjusting mechanism includes a pair of side mounting plates pivotally mounted to an upright portion of the frame F. A link, shown at 49 in FIG. 2, is pivotally mounted at 48 to the frame F and extends forwardly where it is mounted to a side plate 51 which carries one side of the forward cylindrical brush while permitting it to rotate. The brush is pivotally mounted to the frame F of the machine with similar structure on the other side.

A threaded rod 52 is mounted at its lower end to a cross member 53 which extends between and is mounted to the mounting plates 51 which carry the brush 23. The upper portion of the rod 52 is connected to a link 55 as will be described presently. The link 55 (which may be formed from spaced, side-by-side plates) is in the form of a dog leg having one end pivotally mounted at 56 to the frame F of the machine. The other end of the link 55 is pivotally mounted to an arm 57 of an actuator 58 which has its base pivotally mounted at 59 to a cushion mechanism 68 to be described with reference to FIG. 5.

The forward end of a plate member 60 is pivotally mounted at 61 to a bracket 62 which, in turn, is mounted to the frame F of the machine. The other end of the member 60 includes an aperture which is received over a bolt 63 which has its head welded to a mounting plate 64 which forms a part of the frame F. A coil spring 65 is received on the bolt 63 and located between the member 60 and a washer 66 adjacent the head of the bolt 53 near the member 64. The spring 65 (which may be preloaded by tightening the nut 67 on the washer 63) is compressed by, and therefore resists, any upward movement of the shaft 52 to cushion movement of the brush 23 and urge the brush 23 to engage the surface being cleaned when the actuator 58 lowers the cylindrical brush 23 to the use position, illustrated by the solid circle 54 in FIG. 4.

The threaded rod 52 extends through (but is not threaded to) a cross shaft 70 which is rotatably mounted between the dog leg brackets 55 (only the far bracket 55 is seen in FIG. 5). Upper and lower locking knobs 71, 72 are threadedly received on the rod 52, and they may be tightened against the cross shaft 70 to secure the threaded rod 52 to the shaft 70, and thus to the actuator 58.

In operation, when the actuator 58 is extended to the position shown in phantom, in FIG. 5, the rod 52 is forced downwardly, thereby lowering the forward cylindrical brush to the use position shown in solid line at 54 in FIG. 4. When the actuator 58 is energized to the retracted position by the operator, the cylindrical brush 23 is placed in a raised position, disengaged from the floor as indicated in solid line in FIG. 4. It will be observed that the actuator 58 positions only the forward cylindrical brush and, as will be described presently, the raising and lowering of the disc brush set is independent of the raising and lowering of the cylindrical brush. Thus, the machine is capable of operating in the three different conditions described above.

Moreover, the pressure exerted by the forward cylindrical brush 23 on the floor may be adjusted by loosening the locking knobs 71, 72 and rotating them on the threaded rod 52 to raise or lower it to exert the desired downward pressure against the floor surface in the use position, and then relocking the knobs or nuts 71, 72 to maintain the adjusted position. This mechanism may also be used to accommodate wear of the bristles of the cylindrical brush.

Figure 6:
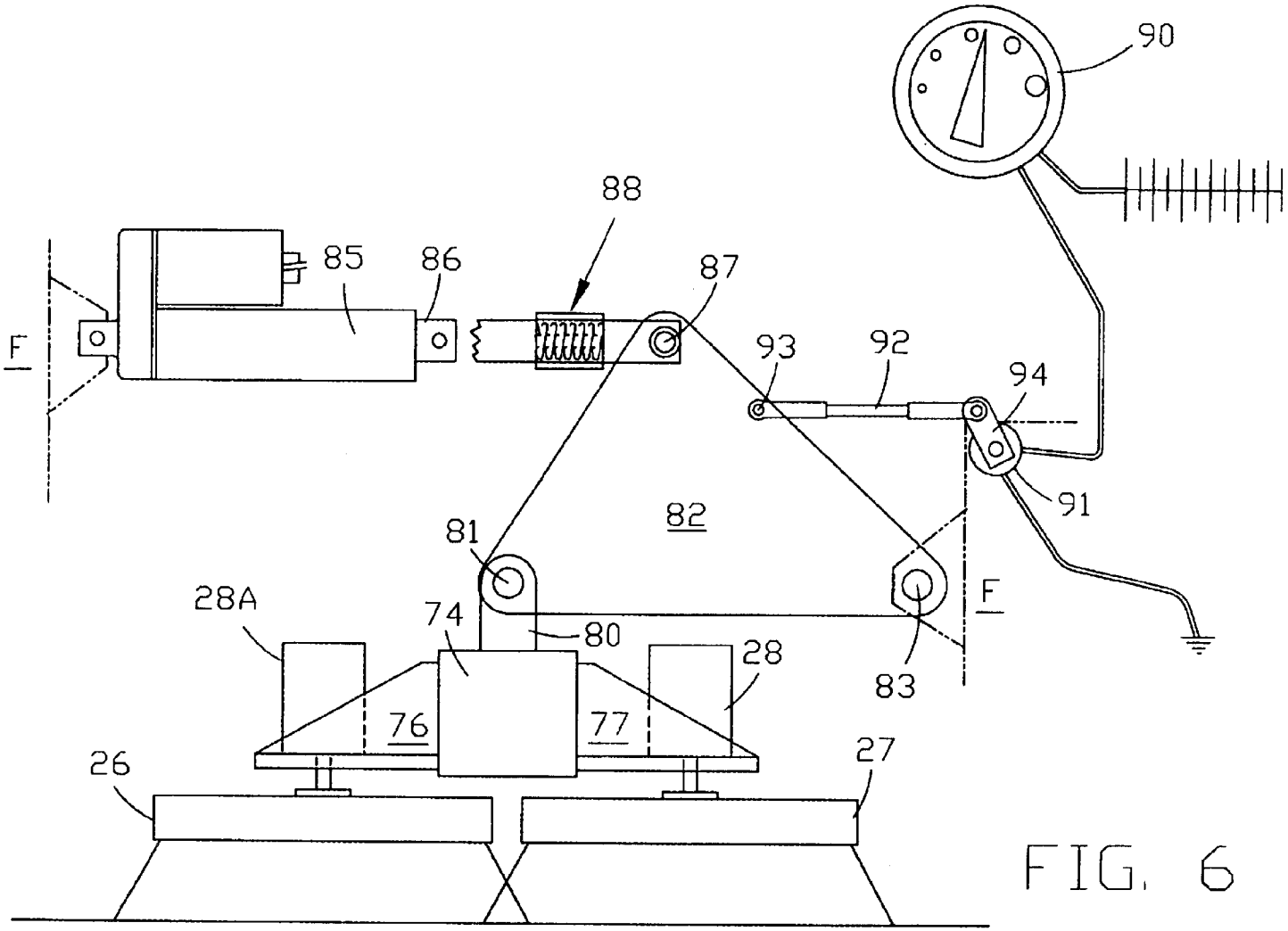
FIG. 6 is a schematic view taken from the right side of the actuating system for the disc brush set of the machine of FIG. 1.

Turning now to FIG. 6 (which is a right side view), there is shown in schematic form the adjustable control mechanism for mounting the rear disc brush set. As mentioned above, the rear set of disc brushes includes a forward, central disc brush 27 and left and right rear disc brushes 25, 26 mounted in side-by-side relation. Each of the three disc brushes is independently mounted to its associated motor by a conventional mount permitting a slight gimbal motion of the brush. All of the drive motors for the brushes are carried by a carrier frame member 74 to which are mounted or welded three horizontal mounting brackets, 75, 76 and 77 for the brushes 25, 26 and 27 respectively, and their associated motors.

The carrier frame 74 is, in turn, mounted by means of a pair of tabs, one of which is shown in FIG. 6 and designated 80 to a pivot pin 81 carried by a link 82 which, in FIG. 6, is in the form of two triangular plates (only one of which is shown) spaced apart, but could equally well be angle members or other configuration. The link 82 is pivotally mounted at 83 to the frame F of the machine. A linear electric actuator 85, similar to the previously described actuator, has its base pivotally mounted to the frame F, and its arm 86 pivotally mounted at 87 to the top of the triangular link 82. The arm 86 may be provided with a conventional cushion mechanism schematically shown at 88. It will be apparent that as the actuator 85 is retracted, the disc brush set is lowered to the used position seen in FIG. 6, and when the actuator 85 is extended, the rear disc brush set is raised to the non-use position.

The actuator 85 may also be used to adjust the operating pressure of the brushes of the rear disc brush set on the floor being treated, independently of any adjustment of the forward cylindrical scrubbing brush, and the approximate pressure may be read on proximity gauge 90 mounted on an operator's console by means of an electrical sensor 91 secured to the frame F and having an arm or link 92 pivotally mounted to the triangular link 82, as at 93 in FIG. 6. The sensor 91 measures the angular rotation of an arm 94 to which the other end of the link is pivotally connected so that the angular position of the arm 94 is a function of the elevated position, and thus the pressure of the disc brushes.

Referring to FIG. 3, water is fed under gravity from tank 15 through a conduit and a manual shut off valve 95 to a spray bar 96 mounted to carrier frame 74 for supplying water to the disc brushes.

Having thus disclosed in detail the illustrated embodiment of the invention, persons skilled in the art will be able to modify certain of the elements which have been illustrated and to substitute equivalent structure for that which has been disclosed while continuing to practice the principle of the invention; and it is, therefore, intended that all such modifications and substitutions be covered as they are embraced within the spirit and scope of the appended claims.

We claim:

1. A machine for scrubbing floors, comprising:

a frame;

ground wheels supporting said frame;

a cylindrical brush carried by said frame for rotation about a horizontal axis extending transverse to a direction of travel of said machine and driven in rotation such that bristles of said cylindrical brush move forwardly and upwardly after engaging the floor to propel debris forwardly;

a hopper located in front of said cylindrical brush and having a pervious bottom wall permitting water to drain therethrough to the floor;

a sprayer for spraying water under force onto said bristles of said cylindrical brush;

a plurality of disc brushes carried by said frame and located to the rear of said cylindrical brush for scrubbing said floor;

a dispenser feeding water to said disc brushes; and a squeegee carried by said frame coupled to a vacuum source to suction water from said floor behind disc brushes.

2. The machine of claim 1 wherein said sprayer comprises a plurality of nozzles for spraying water axially of said cylindrical brush.

3. The machine of claim 2 further comprising a first actuator; a mounting plate connected to said cylindrical brush and pivotally mounted to said frame; and connecting members connected between said first actuator and said mounting plate for adjusting the height of said cylindrical brush.

4. The machine of claim 3 further including a spring cushion mount mounting said actuator to said frame to cushion the action of said cylindrical brush.

5. The machine of claim 3 wherein said connecting members include a threaded rod pivotally coupled at a lower end to said mounting plate for said cylindrical brush and threadedly connected to a member attached to said first actuator; and further including threaded locking members received on said threaded rod in opposing relation for adjustably securing said rod to said first actuator.

6. The machine of claim 1 wherein said disc brushes include three disc brushes mounted to a carrier frame; and futher including a link having a first pivotal connection to said frame, a second pivotal connection to said carrier frame, and a third pivotal connection; a second actuator having an arm pivotally connected to said third pivotal connection of said link, whereby said first and second actuators operate said cylindrical brush and said disc brushes independently of one another.

7. The machine of claim 6 further comprising a second cushion device for cushioning the mounting of said second actuator to said link.

8. The machine of claim 6 further comprising a sensor sensing the position of said link relative to said frame; and a display responsive to said sensor for generating a signal representative of the pressure of said disc brushes on the floor.

9. The machine of claim 8 characterized in that said disc brushes may be used alone, or said cylindrical brush may be used alone, or said disc brushes and said cylindrical brush may be used together.

10. The machine of claim 1 further comprising an elongated flexible containment flap carried by said frame and extending axially of said cylindrical brush and located behind said cylindrical brush to collect water on the floor, said containment flap having an opening adjacent said floor to permit collected water to pass therethrough for recovery by said squeegee.

11. The machine of claim 10 further comprising an elongated recirculation flap mounted behind said cylindrical brush and engaging bristles of said cylindrical brush as they pass to cause said bristles to snap and dislodge debris from said bristles in a forward motion.

12. The machine of claim 11 further comprising a wall hinged to said bottom of said hopper and depending therefrom to provide a ramp from the floor to said hopper for guiding debris from said cylindrical brush to said hopper.

* * * * *